US010021956B2

(12) United States Patent
Clark

(10) Patent No.: US 10,021,956 B2
(45) Date of Patent: Jul. 17, 2018

(54) MODULAR WATER BOTTLE SYSTEM

(71) Applicant: Franklin D. Clark, Phoenix, AZ (US)

(72) Inventor: Franklin D. Clark, Phoenix, AZ (US)

( * ) Notice: Subject to any disclaimer, the term of this patent is extended or adjusted under 35 U.S.C. 154(b) by 128 days.

(21) Appl. No.: 15/246,245

(22) Filed: Aug. 24, 2016

(65) Prior Publication Data

US 2017/0057691 A1 Mar. 2, 2017

Related U.S. Application Data

(60) Provisional application No. 62/210,371, filed on Aug. 26, 2015.

(51) Int. Cl.
*A45F 3/18* (2006.01)
*A45F 3/16* (2006.01)

(52) U.S. Cl.
CPC . *A45F 3/18* (2013.01); *A45F 3/16* (2013.01)

(58) Field of Classification Search
CPC ..... A45F 3/18; A45F 3/16
USPC ..... 362/101
See application file for complete search history.

(56) References Cited

U.S. PATENT DOCUMENTS 5,743,620 A * 4/1998 Rojas ..... A47G 19/2227 215/386
2003/0146227 A1* 8/2003 Shimazaki ..... F25D 3/08 220/737
2006/0102581 A1* 5/2006 Yates, III ..... B65D 81/3216 215/6
2014/0211456 A1* 7/2014 Hoy ..... F21V 33/0036 362/101

FOREIGN PATENT DOCUMENTS

WO WO 03093130 A1 * 11/2003 ..... A45F 3/18

* cited by examiner

*Primary Examiner* — David V Bruce
(74) *Attorney, Agent, or Firm* — The Keith Miller Law Group; Keith A. Miller

(57) ABSTRACT

The invention described herein is a modular water bottle system comprising an inner bottle, where an outer shell, further comprising an open top portion and an open bottom portion, fits around the inner bottle, where a base member is removably threaded onto the outer shell bottom portion, and where a cap assembly is removably threaded onto the outer shell top portion, where a sealing ring positioned around a neck of the inner bottle press seals against the an inner surface of the outer shell when the cap assembly is threaded onto the outer shell top portion. A design insert may be positioned between the inner bottle and the outer shell.

19 Claims, 5 Drawing Sheets

MODULAR WATER BOTTLE SYSTEM

CROSS-REFERENCE TO RELATED APPLICATIONS

The present application is related to and claims priority from prior provisional application Ser. No. 62/210,371, filed Aug. 26, 2015, entitled "MODULAR WATER BOTTLE SYSTEM", the contents of all of which are incorporated herein by this reference and are not admitted to be prior art with respect to the present invention by the mention in this cross-reference section.

BACKGROUND OF INVENTION

The present invention relates generally to a modular water bottle system for use in everyday activities. Conventional water bottles typically contain either no design or the design is fixed on the outside of the bottle and cannot be removed or changed at will. Additionally, the typical glass bottle can be broken easily if carelessly dropped on the ground and causes sharp glass shards to be a danger. In outdoor settings, it is very difficult to clean up all of the glass shards if a glass bottle is dropped and shatters. For this reason, many venues don't allow glass bottles on the premises.

However, glass remains the best material to produce bottles due to no chemicals used and ease of cleaning. Additionally, glass is 100% recyclable. You don't have to worry about toxins like BPA or other harmful chemicals that can leach into liquids from plastic bottles, or heavy metals like aluminum, chromium and nickel that can leach from metal bottles. Your beverage will taste better coming out of glass, with no unpleasant plastic or metallic taste or smell. Using a reusable glass bottle also benefits the environment. Bottled water creates enormous quantities of waste, so you'll save money and the planet's resources by using a reusable glass bottle.

Traditionally, glass is easy to break, but difficult to clean up the shards. Silicone sleeves do not contain the shattered glass if the bottle breaks. The present invention is not only very break resistant, but it is very shatterproof. If you drop the modular water bottle system and the glass bottle breaks, all of the glass will remain contained inside the plastic shell. Because the present invention is a modular design, if the inner glass bottle breaks, a user can easily replace the glass bottle without having to dispose of the entire water bottle system. Also, if any component of the modular water bottle system breaks or is lost, a user only has to replace that particular component instead of the entire water bottle.

More specifically, the present invention relates to a modular water bottle system allowing a consumer to personalize their water bottle with a distinct design and change that design at any time they choose.

BRIEF SUMMARY OF THE INVENTION

The present invention creates a modular water bottle system by providing a system where the various components of the modular water bottle can be interchanged with different colored components. The modular water bottle system is sealed on the bottom by a removably attached threaded base member. A removably attached threaded cap assembly seals against both the inner bottle and the outer shell using a threaded fastening system providing a water-proof assembly.

Additionally, the present invention comprises a removable filter to be placed in the cap assembly of the modular water bottle system so the user can brew their own tea or infuse their drink with various fruits and vegetables within the modular water bottle system.

Additionally, a removable design insert may be placed between the inner glass bottle and the outer sleeve by disassembling the modular water bottle system and inserting the design insert into the gap between the inner glass bottle and the outer sleeve, then re-assembling the modular water bottle system without removing any liquid within the glass bottle.

BRIEF DESCRIPTION OF THE DRAWINGS

The particular objects and features of the invention as well as the advantages will become apparent from the following description taken in connection with the accompanying drawings in which.

DETAILED DESCRIPTION OF THE INVENTION

The following description of the preferred embodiments of the invention is intended to enable someone skilled in the prior art to make and use this invention, but is not intended to limit the invention to these preferred embodiments.

Figure 1:
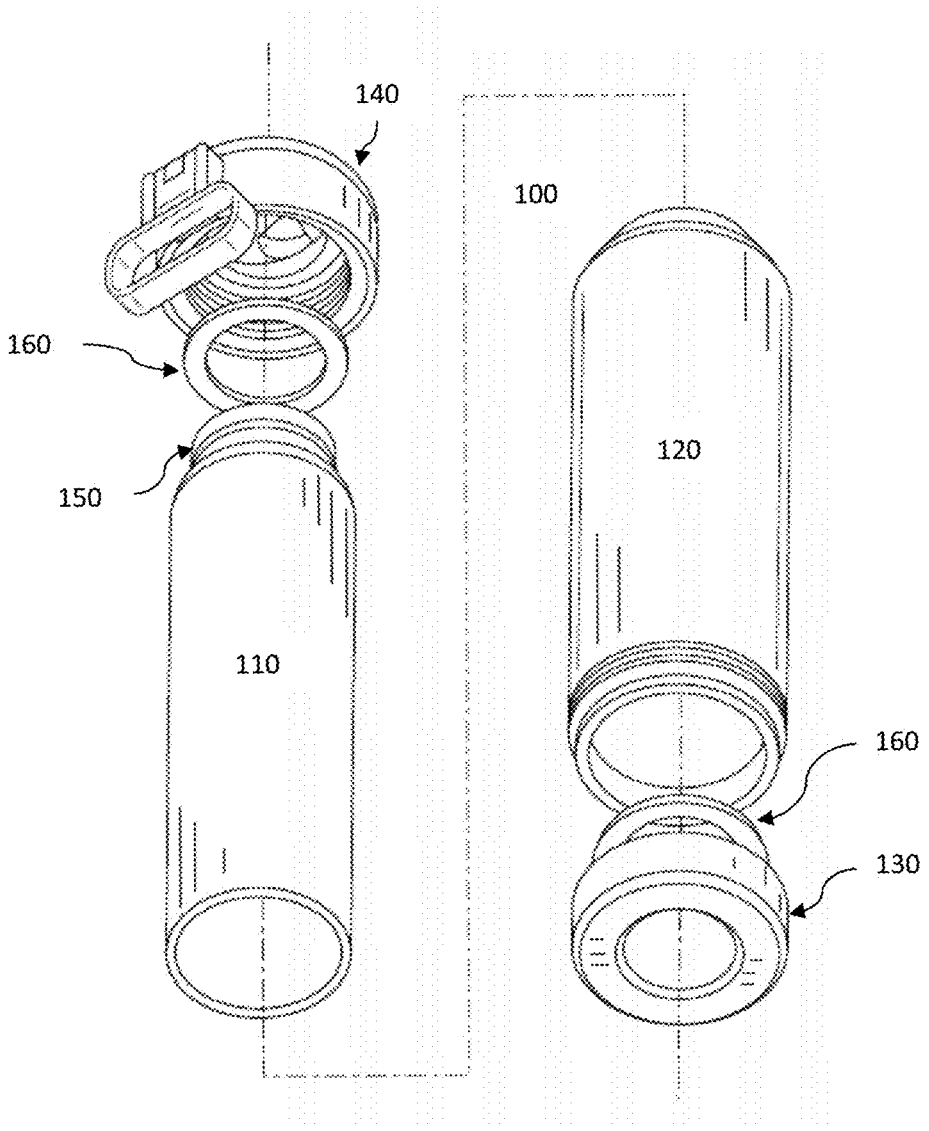
FIG. 1 is an exploded perspective view of the MODULAR WATER BOTTLE SYSTEM of the preferred embodiment.

Referring now to FIG. 1, the invention described herein is a modular water bottle system 100 comprising an inner bottle 110, where an outer shell 120, further comprising an open top portion and an open bottom portion, fits around the inner bottle 110, where a base member 130 is removably threaded onto the outer shell bottom portion, and where a cap assembly 140 is removably threaded onto the outer shell top portion, where a sealing ring positioned around a neck 150 of the inner bottle 110 press seals against an inner surface of said outer shell 120 when the cap assembly 140 is threaded onto the outer shell top portion.

As further shown in FIG. 1, the inner bottle 110 is preferably made from glass. However, the inner bottle 110 may be manufactured with other materials not enumerated herein. The inner bottle 110 preferably comprises a relatively flat bottom and a top portion further comprising a neck with an opening.

The outer shell 120 is preferably made from a durable semi-flexible copolyester plastic material. The outer shell 120 is preferably formed to have an open top portion and an open bottom portion, and where both the open top portion and open bottom portion further comprise a male threaded section. The copolyester plastic material is preferably thick enough to contain glass shards should the inner bottle break while the modular water bottle system is fully assembled. Other semi-rigid materials may be used to form the outer shell, such as polycarbonate plastic, not enumerated herein such that the material is strong enough to encapsulate and prevent any shards of the inner bottle from penetrating through the outer shell if the inner bottle should break.

As shown in FIG. 1, the sealing ring 150 is preferably applied to the outside of the neck of the inner bottle 110. The sealing ring 150 is preferably comprised of a silicone-type rubber material, or other rubber-type material providing a liquid-proof seal. The sealing ring 150 is preferably applied by fitting over the opening of the inner bottle and providing a compression fit over the neck of the inner bottle. Preferably, the sealing ring 150 will seat at the transition between the neck of the inner bottle and where the neck expands to the full width of the inner bottle. Alternately preferably, the sealing ring 150 may be affixed to the inner bottle using a using a silicone adhesive to adhere to the surface of the inner bottle.

As further shown in FIG. 1, the cap assembly 140 preferably further comprises a sealing gasket 160 structured and arranged to provide a seal between the inside of the cap assembly lower section and the top circumference of the outer shell. The sealing gasket 160 is preferably made from silicone-type rubber material. However, the sealing gasket 160 made be constructed from any material not enumerated herein that adequately seals and prevents liquid from entering the gap between the inner bottle and outer shell.

Figure 2:
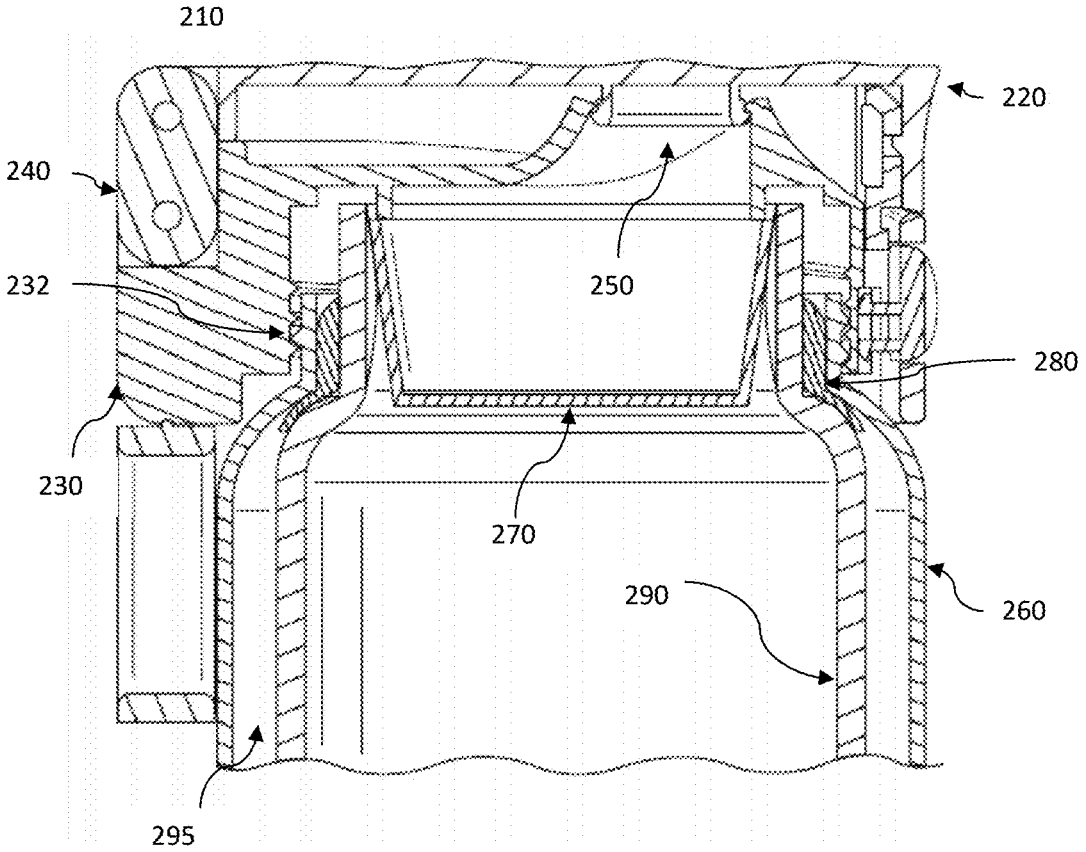
FIG. 2 is a cross-sectional view of the top cap assembly of the MODULAR WATER BOTTLE SYSTEM of the preferred embodiment.

As shown in FIG. 2, the cap assembly 210 is preferably comprised of an upper section 220 and a lower section 230, where the two sections are connected with a hinge assembly 240. The cap assembly lower section 230 is preferably comprised of female threads within the vertical walls 232 and an opening 250 corresponding to the opening in the neck of the inner bottle. The cap assembly 210 is preferably structured and arranged to be removably threaded onto the top male threaded portion of the outer shell 260 such that the opening 250 in the cap assembly lower section 230 is positioned relatively in line with the neck opening of the inner bottle 290.

As further shown in FIG. 2, the cap assembly 210 preferably further comprises a sealing ring 280 such that when the cap assembly 210 is threadably attached to the outer shell 260, the outer shell 260 is preferably squeezed onto the sealing ring 280 of the inner bottle 290 providing a liquid-proof seal. The liquid-proof seal preferably prevents liquid inside the inner bottle 290 from leaking into the area between the inner bottle 290 and the outer shell 260.

As further shown in FIG. 2, when assembled, the construction of the modular water bottle system preferably creates an air gap 295 between the inner bottle and the outer shell. The air gap 295 preferably acts as an insulation barrier to heat transfer thereby keeping the liquid within the inner bottle either hot or cold. Additionally, the user's hand is protected against the hot or cold liquid within the inner bottle by gripping the outer shell when the modular water bottle system is assembled and in use.

As further shown in FIG. 1, the base member 130 is preferably comprised of a relatively flat bottom with a circular-shaped horizontal surface and a vertical wall extending upward, further comprising molded-in female threads structured and arranged to threadably interlock with the male threads of the outer shell bottom portion. The base member 130 preferably further comprises a sealing gasket 160 that seats against the outer shell bottom portion to provide a liquid-proof seal when threadably attached. The base member 130 is preferably comprised of a food-grade thermoplastic polymer; however, the base member 130 may be constructed of other materials not elaborated herein.

Figure 6:
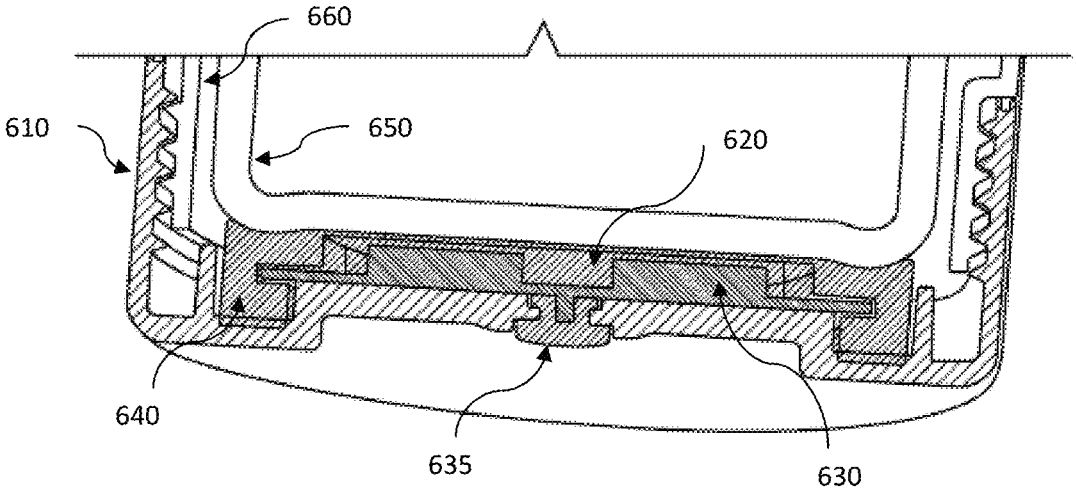
FIG. 6 is a cut-away view of the base member of the MODULAR WATER BOTTLE SYSTEM of an alternate embodiment.

In an alternate embodiment, as shown in FIG. 6, the base member 610 preferably further comprises an LED light assembly 620. The LED light assembly 620 preferably further comprises a circuit board 630 and a sleeve 640. The circuit board 630 preferably further comprises at least one colored LED light, at least one replaceable battery structured and arranged to power the at least one LED light, and a push button switch 635 The push button switch 635 is preferably located on a bottom surface of the circuit board to protrude from the bottom surface of the base member 610 such that a user can access the push button while the base member is threadably attached to the outer shell. The at least one LED light and at least one battery are located on a top surface of the circuit board 630. The circuit board 630 is preferably located within a sleeve 640 to protect the LED light assembly from liquid while in use.

The sleeve 640 is then fitted into the base member and the base member is threadably attached to the modular water bottle system. The sleeve preferably presses against the inner bottle 650 when the base member is threadably attached to the outer shell 660. The sleeve 640 is preferably made of a silicone rubber material to provide a liquid-proof seal to the circuit board 630. The LED light assembly 620 is preferably structured and arranged in the base member such that the LED lights illuminate upwards towards the inner bottle when activated. Alternately preferably, the base member 610 may be clear and the LED lights 632 illuminate through the base member when activated. The LED light assembly 620 may further comprise different colored LED lights and effects. Examples of the effects include a fast light blink, a slow light blink, a solid light, and other effects not enumerated herein. The LED light assembly 620 is preferably accessible while the base member is removed from the modular water bottle assembly.

As further shown in FIG. 1, the outer shell 120 is preferably a tubular-shaped sleeve formed with an opening at the bottom portion and the top portion. The bottom portion and the top portion of the outer shell 120 preferably comprise male threads formed to accept the female threaded portions of the base member 130 and the cap assembly 140. The outer shell top portion preferably comprises a narrower opening than the bottom portion of the outer shell 120. The top portion of the outer shell is formed to engage in a press fit against the sealing ring 150 on the inner bottle neck when the cap assembly 140 is threadably fastened onto the top of the outer shell 120. The opening at the outer shell 120 bottom portion is preferably wide enough to accommodate insertion of the inner bottle 110.

As shown in FIG. 2, an optional filter assembly 270 is preferably structured and arranged to be removably located in the neck of the inner bottle. The filter assembly 270 is preferably used to allow a user to brew tea, or infuse other fruits and/or vegetables into the liquid within the inner bottle 290. Liquid is placed inside the inner bottle 290 along with loose tea leaves, or other fruit and/or vegetables, to be infused into the liquid. The filter assembly 270 is then preferably placed into the neck opening of the inner bottle 290 and the cap assembly 210 is threadably attached to the outer shell 260. The optional filter assembly 270 prevents the loose tea leaves, or other fruit and/or vegetables, from exiting the inner bottle when a user drinks the infused liquid.

Figure 2A:
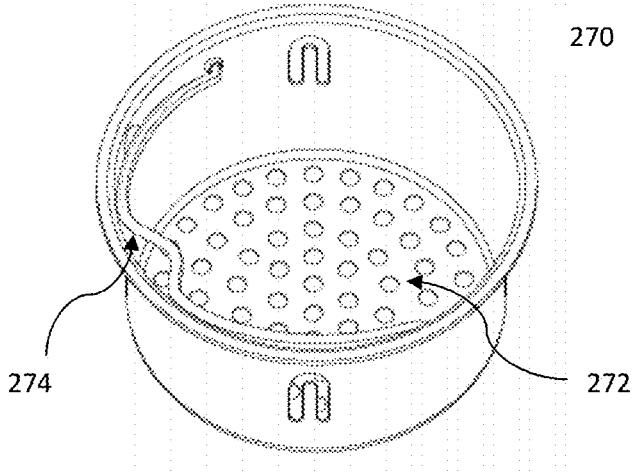
FIG. 2A is a perspective view of the filter assembly of the MODULAR WATER BOTTLE SYSTEM of the preferred embodiment.

As further shown in FIG. 2A, the filter assembly 270 is preferably formed in a downward semi-conical shape with a number of slots and/or holes 272 along the sides and/or bottom of the filter assembly 270 for liquid to flow through. The bottom of the filter assembly may be relatively flat, rounded or it may end in a point. An upwardly curved handle 274 is attached to the top circumference of the filter assembly 270 approximately 180 degrees apart and is allowed to pivot so that it can lie flat along the inside of the top circumference of the filter assembly 270 while in the neck of the inner bottle and can be used to lift the filter assembly out of the neck of the inner bottle when not in use.

Figure 3:
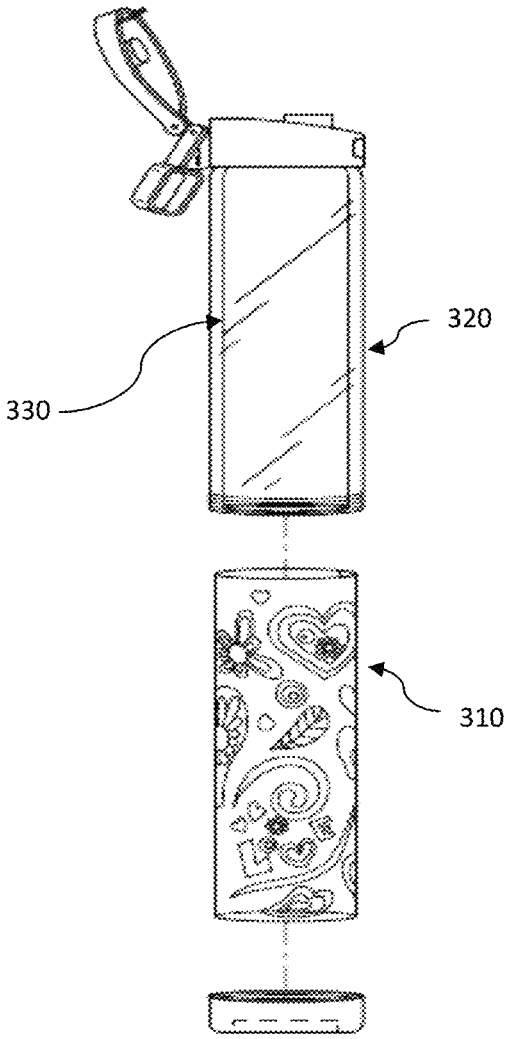
FIG. 3 is an exploded perspective view showing the insertion of a design insert of the MODULAR WATER BOTTLE SYSTEM of the preferred embodiment.

As shown in FIG. 3, the modular water bottle system is designed to accept a design insert 310 preferably positioned between the outer shell 320 and the inner bottle 330. The design insert 310 is preferably removed by disassembling the modular water bottle system and removing the design insert 310 from inside the outer shell 320. The user then preferably selects a second design insert and rolls it into a tubular shape. The user then inserts the rolled second design insert into the outer shell 320 and reassembles the modular water bottle system. The modular water bottle system is structured and arranged to allow removal and replacement of the design insert 310 with a second design insert without having to empty the liquid contents of the inner bottle 330.

As further shown in FIG. 3, the design insert 310 is preferably comprised of a sheet material with or without designs printed on it. The design insert 310 is preferably further comprised of a clear plastic, a sheet paper, or any insulation-type material such as neoprene rubber. Other materials not enumerated herein may be used for the design insert without limitation. Additionally, the graphic design may be comprised of any personal graphic design, custom graphic design or commercial advertisement printed on the sheet material outside surface such that the design is visible when properly positioned in the modular water bottle system. Other graphic designs not enumerated herein may be considered without limitation.

Figure 4:
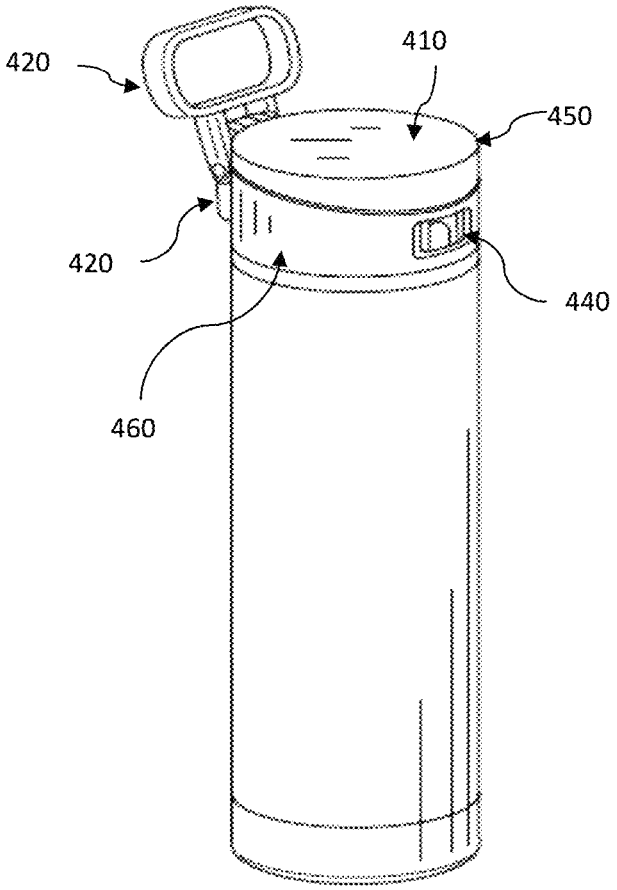
FIG. 4 is a perspective view of the MODULAR WATER BOTTLE SYSTEM of the preferred embodiment.

As shown in FIG. 4, the cap assembly 410 further comprises a carry handle 420 attached to the hinge assembly 430, and a locking mechanism 440 to keep the cap assembly upper section 450 secured and sealed to the cap assembly lower section 460. The hinge assembly 430 is structured and arranged to allow the cap assembly upper section 450 to pivot upwards and allow the user access to the liquid inside the inner bottle. The cap assembly 410 is preferably comprised of a food-grade thermoplastic polymer; however, the cap assembly 410 may be constructed of other materials not elaborated herein. Alternately preferably, a flexible wrist strap is attached to the hinge assembly 430 for a user to loop around their wrist while carrying the modular water bottle system.

Figure 5:
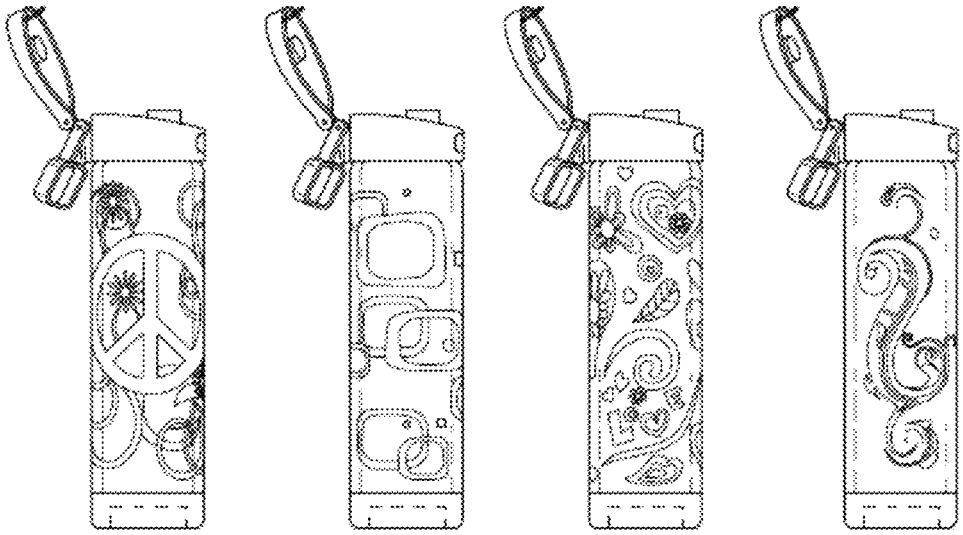
FIG. 5 is a perspective view showing different design inserts of the MODULAR WATER BOTTLE SYSTEM of the preferred embodiment.

As shown in FIG. 5, different design inserts can preferably be removed and inserted within the modular water bottle system. By allowing a user to have one modular water bottle system and multiple design inserts, the user can customize the look and feel of the modular water bottle system whenever they want.

As shown in FIG. 1, a method of using a modular water bottle system comprising the steps of: inserting an inner bottle into an outer shell through the bottom of the outer shell; threadably attaching a cap assembly onto the top portion of the outer shell, sealing the outer shell to the inner bottle; and attaching the base member onto the bottom portion of the outer shell.

Additionally, the modular water bottle system is structured and arranged to accept a removable design insert within the gap between the inner bottle and the outer shell. To insert a design insert into the modular water bottle system, begin by disassembling the modular water bottle system, rolling a design insert into a tubular shape, sliding the design insert between the inner bottle and the outer shell, and reassembling the modular water bottle system.

What is claimed is:

1. A modular water bottle system comprising an inner bottle, wherein an outer shell, further comprising an open top portion and an open bottom portion, fits around said inner bottle, wherein a base member is removably threaded onto said outer shell bottom portion, and wherein a cap assembly is removably threaded onto said outer shell top portion; wherein a sealing ring positioned around a neck of said inner bottle press seals against an outer shell inner surface when said cap assembly is threaded onto said outer shell top portion.

2. The modular water bottle system of claim 1, further comprising an at least one design insert positioned between said outer shell and said inner bottle.

3. The modular water bottle system of claim 2, wherein said at least one design insert can be removed and replaced without emptying an amount of liquid within said inner bottle.

4. The modular water bottle system of claim 2, wherein said at least one design insert is a clear plastic sheet with a graphic design printed on a surface.

5. The modular water bottle system of claim 2, wherein said at least one design insert is a rubber material to provide greater insulation properties.

6. The modular water bottle system of claim 5, wherein said at least one design insert further comprises a graphic design printed on an outside surface.

7. The modular water bottle system of claim 5, wherein said rubber material is neoprene.

8. The modular water bottle system of claim 1, wherein said inner bottle is glass.

9. The modular water bottle system of claim 1, wherein said outer shell is a semi-rigid copolyester plastic material.

10. The modular water bottle system of claim 1, further comprising a filter assembly structured and arranged to fit within an opening of said inner bottle.

11. The modular water bottle system of claim 1, wherein said base member further comprises an LED light assembly, wherein at least one LED light, at least one battery, and a switch are located on a board, wherein a sleeve is structured and arranged to encapsulate said board, and wherein said switch protrudes through a bottom surface of said base member to activate said LED light assembly.

12. The modular water bottle system of claim 11, wherein said LED light assembly is capable of multiple effects.

13. The modular water bottle system of claim 11, wherein said sleeve is further comprised of silicone rubber to provide liquid-proof seal.

14. The modular water bottle system of claim 1, further comprising an at least one design insert located between said inner bottle and said outer shell; and wherein an LED light assembly, further comprised of an at least one LED light, at least one battery, a switch, and a sleeve is positioned within said base member.

15. A modular water bottle system comprising an inner bottle, wherein an outer shell, further comprising an open top portion and an open bottom portion, fits around said inner bottle, wherein a base member further comprising an LED light assembly is removably threaded onto said outer shell bottom portion, and wherein a cap assembly is removably threaded onto said outer shell top portion, wherein a sealing ring positioned around a neck of said inner bottle seals against said an outer shell inner surface when said cap assembly is threaded onto said outer shell top portion.

16. The modular water bottle system of claim 15, wherein an at least one LED light, at least one battery, and a switch are located on a board, wherein a sleeve is structured and arranged to encapsulate said board, and wherein said switch protrudes through a bottom surface of said base member to activate said LED light assembly.

17. The modular water bottle system of claim 16, wherein said sleeve is silicone to provide a liquid-proof seal.

18. A method of using a modular water bottle system comprising the steps of: threadably removing a base member, threadably removing a cap assembly, sliding an inner bottle out of an outer shell, sliding said inner bottle into said outer shell, threadably attaching said cap assembly, rolling a design insert into a tubular shape, inserting said design insert inside said outer shell, and threadably attaching said base member.

19. The method of claim 18 wherein all of the steps may be performed while the inner bottle contains an amount of liquid.

* * * * *